US005214361A

United States Patent [19]

Labruyere

[11] Patent Number: 5,214,361

[45] Date of Patent: May 25, 1993

[54] DEVICE FOR SUPPORTING AND ROTATING A PAYLOAD RELATIVE TO A STRUCTURE, IN PARTICULAR FOR A SATELLITE ANTENNA POINTING MECHANISM

[75] Inventor: Gilles Labruyere, Oegstgeest, Netherlands

[73] Assignee: Agence Spatiale Europeenne, Paris, France

[21] Appl. No.: 831,048

[22] Filed: Feb. 4, 1992

[30] Foreign Application Priority Data

Feb. 8, 1991 [FR] France ..... 91 01438

[51] Int. Cl.[5] ..... H01Q 3/02

[52] U.S. Cl. ..... 318/560; 901/15; 343/758; 343/766

[58] Field of Search ..... 318/560; 901/14, 15, 901/23, 24, 27, 28; 343/757, 758, 759, 763, 765, 766; 310/66, 67 R

[56] References Cited

U.S. PATENT DOCUMENTS 3,861,243 1/1975 Fleischer .
4,920,349 4/1990 Le Gall ..... 343/709
5,064,340 11/1991 Genov et al. ..... 414/744.5
5,091,733 2/1992 Labruyere ..... 343/882

FOREIGN PATENT DOCUMENTS 0077490 10/1982 European Pat. Off. .
2588049 10/1985 France .

OTHER PUBLICATIONS

Patent Abstracts of Japan, vol. 7, No. 94 (E-171) (1239) Apr. 20, 1983; & JP-A-58019005 (Nippon Denki K.K.) Mar. 2, 1983.

*Primary Examiner*—Bentsu Ro
*Attorney, Agent, or Firm*—Wegner, Cantor, Mueller & Player

[57] ABSTRACT

A device for supporting and rotating a payload relative to a structure comprises a first coupling ring joined to the payload and a second coupling ring joined to the structure. A pair of annular bearings guide rotation of the first coupling ring relative to the second coupling ring. An annular motor has a stator fixed to one of the coupling rings and a rotor rotating the other coupling ring through a differential epicyclic train disposed inside the annular bearings.

9 Claims, 2 Drawing Sheets

DEVICE FOR SUPPORTING AND ROTATING A PAYLOAD RELATIVE TO A STRUCTURE, IN PARTICULAR FOR A SATELLITE ANTENNA POINTING MECHANISM

BACKGROUND OF THE INVENTION

1. Field of the Invention

The present invention concerns a device for simultaneously rotating a payload relative to a structure and supporting the payload (and therefore guiding its rotation).

The invention concerns a device of this type, also known as a "rotation drive table", which can be used in diverse applications, in particular in a satellite antenna pointing mechanism.

In this type of application the antenna beam can be oriented by rotating the parabolic reflector about its focal point.

2. Description of the prior art

To this end, until now either the reflector has been attached to a universal joint structure centered on the focal point by an arm and the universal joint has been motorized or the concept explained in the document FR-A-2 646 023 has been used.

In either case, the drive units must combine great stiffness, high angular resolution, compact overall dimensions and a high drive torque.

There has not previously existed any mechanism combining all these qualities and capable of driving a high inertia load (typically in the order of 200 kg.m$^2$) with a sufficient natural frequency.

These problems also arise in many other applications such as pointing a telescope or driving robot arms.

An object of the invention is to propose a support and drive device which meets these various requirements and which can be used not only in the applications just mentioned but also in all fields where the aforementioned qualities are found to be advantageous.

SUMMARY OF THE INVENTION

The invention consists in a device for supporting and rotating a payload relative to a structure comprising:

- a first coupling ring joined to the payload;
- a second coupling ring joined to the structure;
- a pair of annular bearings for guiding rotation of the first coupling ring relative to the second coupling ring;
- a differential epicyclic train disposed inside the annular bearings; and
- an annular motor having a stator fixed to one of the coupling rings and a rotor rotating the other coupling ring through said train.

According to other characteristic aspects of the invention:

- the rotor of the motor is joined to a satelliteholder of the train which supports and rotates two inner wheels of the train each of which meshes with a respective one of two outer wheels of the train each of which is constrained to rotate with a respective one of the first and second coupling rings;
- the inner and outer wheels and the satelliteholder of the train are disposed within an inner central space defined radially and axially by inner races of the two annular bearings;
- the annular drive motor is outside the inner central space and is axially offset relative to the train;

- the satellite-holder is of substantially annular shape so as to provide at the center of the device a central passage around the rotation axis of the device;
- the pair of annular bearings comprises two taper roller bearings mounted back-to-back;
- the device is incorporated in a spacecraft such as a launch vehicle, a satellite, an orbital space station or a space shuttle;
- the device is employed to orient a mechanism comprising a set of sensors such as a telescope;
- the device is used to rotate a robot or like automatic device.

Other features and advantages of the invention will emerge from the following detailed description given by way of non-limiting example with reference to the appended drawings.

DETAILED DESCRIPTION OF THE INVENTION

Figure 1:
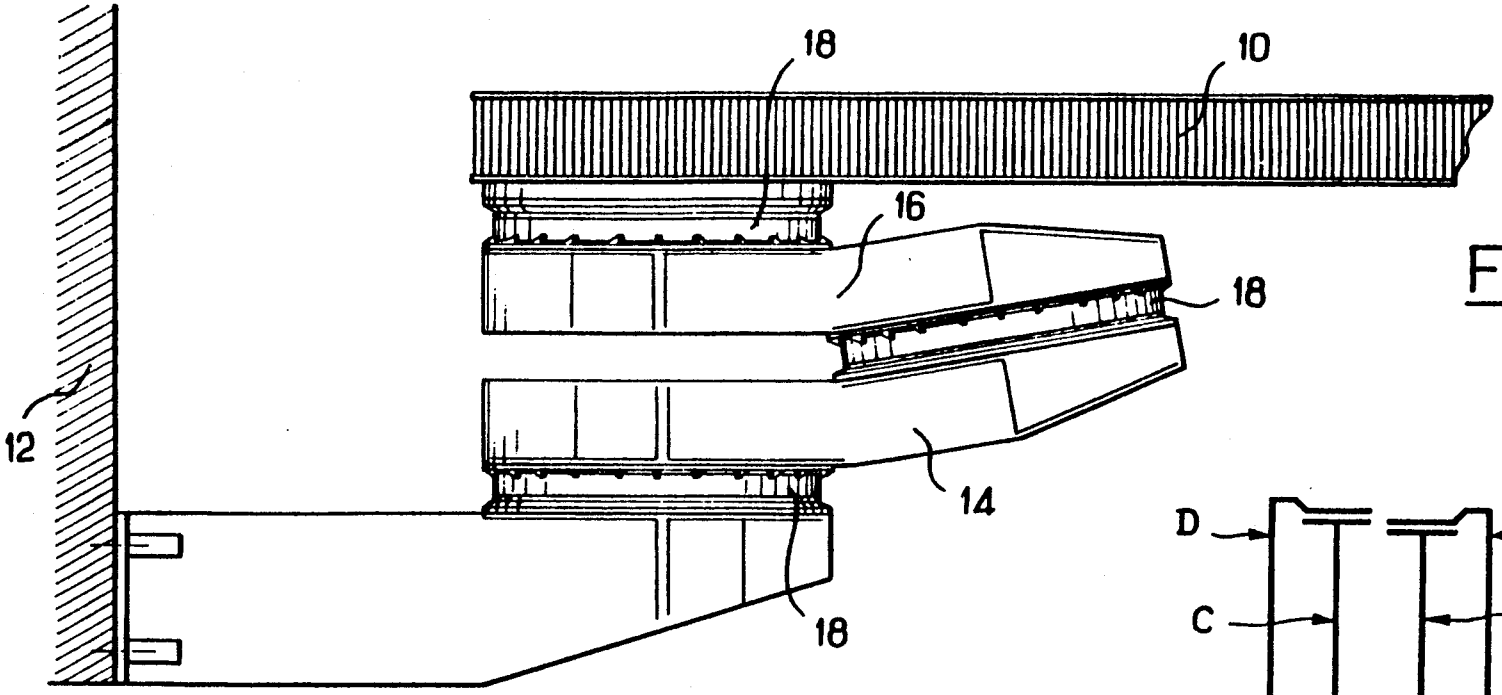
FIG. 1 is a diagrammatic view of a satellite antenna pointing device incorporating one or more support and drive device is in accordance with the invention.

FIG. 1 shows an antenna pointing device of the type described and shown in the aforementioned document FR-A-2 646 023 to which reference may usefully be had for more details as to its construction and operation.

It essentially comprises an antenna reflector 10 mounted to move relative to the structure 12 of a spacecraft or a satellite by means of two articulated arms 14 and 16 which are articulated to each other. The three articulations are each provided and driven by a support and drive device 18.

Each of these support and drive devices or "rotation drive tables" may be a device in accordance with the invention.

Figure 2:
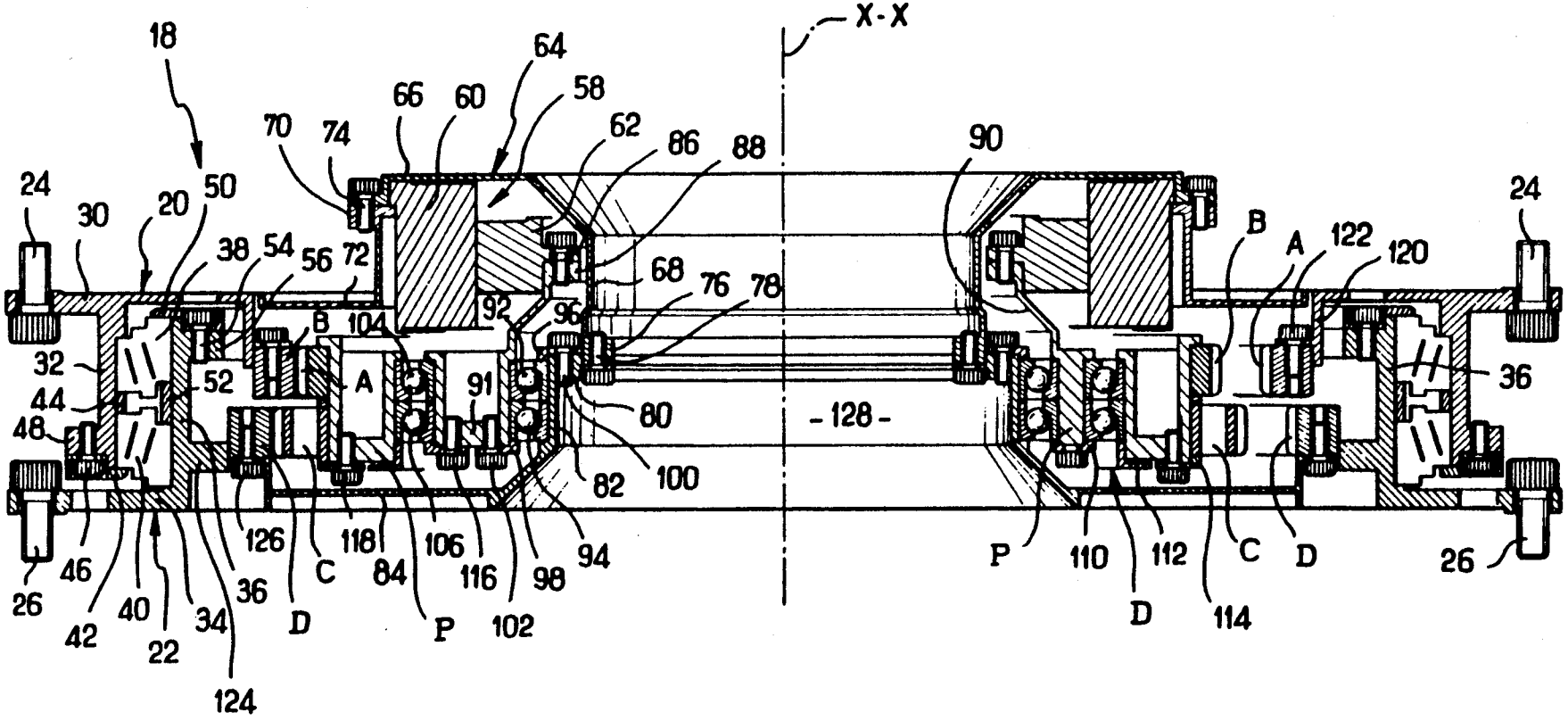
FIG. 2 is a view in axial cross-section of a preferred embodiment of the support and drive device in accordance with the invention.

Referring to FIG. 2, a device 18 is provided to rotate about a rotation axis X—X a first member (not shown) fixed to a first annular coupling ring 20 relative to a second member (not shown) fixed to a second annular coupling ring 22.

The first ring 20 is, for example, connected to a payload which is to be rotated relative to the structure of the satellite which is connected to the second coupling ring 22. These connections are provided, for example, by respective series of screws 24 and 26 distributed around the periphery of the rings 20 and 22.

The first ring 20 incorporates an annular plate 30 which is extended axially towards the second coupling ring 22 by an outer cylindrical wall 32.

Similarly, the second ring 22 comprises an annular plate 34 extended axially by an inner cylindrical wall 36.

The two walls 32 and 36 are coaxial about a common axis X-X and guide rotation of the first ring 20 relative to the second ring 22.

To this end the device 18 comprises a pair of taper roller bearings 38 and 40 mounted back-to-back, the tips of the cones defined by the action lines of the rolling members perpendicular to the surfaces in contact facing in opposite directions.

The outer races of the two bearings 38 and 40 are clamped into the cylindrical wall 32 by a clamping plate 42 and an interposed spacer 44. The plate 42 is clamped by means of screws 46 which screw into an outer radial extension 48 of the wall 32.

In a symmetrical manner, the inner races of the bearings are clamped by means of a clamping plate 50, a spacer 52 and screws 54 screwed into an inner radial extension 56 of the inner wall 36.

The manner in which the bearings are mounted makes the assembly very stiff in bending.

By virtue of their geometry, the taper roller bearings reduce friction as compared with ball bearings of the same capacity and with the same axial preliminary loading.

The mounting and the clamping of the bearing races offers very accurate control over the preliminary axial loading of the bearings.

For applications in which contamination is critical provision is made for so-called "dry" lubrication of the bearings, for example using a known compound based on molybdenum bisulfide. So-called "wet" lubrication is possible for other applications.

The first ring 20 is rotated relative to the second ring by an annular electric motor 58.

The motor 58 comprises an annular cylindrical stator 60 and a cylindrical annular rotor 62 which are coaxial about a common axis X-X.

The stator 60 is fixed to a support part 64. The support 64 is a body of revolution comprising an annular plate portion 66 which is extended axially by a cylindrical portion 68.

The stator 60 is clamped axially against the inside surface of the plate 66 by means of a shoulder 70 on an annular protection plate 72 and by fixing screws 74.

The axial end part 76 of the cylindrical portion 68 is fixed by screws 78 to the axial end part 80 of a cylindrical portion 82 which extends the radially innermost annular plate part 84 of the second coupling part 22.

In this way the stator 60 is fixed and rotationally coupled to the second coupling ring 22. It is disposed axially opposite the second coupling ring 22 and extends axially beyond the radial plane of the plate 50 of the first coupling ring 20.

The rotor 62 is fixed by means of screws 86 received in an inner radial shoulder 88 formed at the axial end of an extension 90 of the satellite-holder of an epicyclic train whose construction will be described later.

Note that although in the embodiment shown the annular drive motor 58 is offset axially relative to the train, this is not mandatory and depends on design constraints, in particular the maximum size assigned to the table. Thus in the case of a large diameter table the motor could be located inside the train, within the thickness of the table, which would simplify the general construction of the device.

The motor 58 is an annular stepper motor. Step by step control can be implemented in microsteps to increase the angular resolution of the device and to reduce the acceleration peaks inherent to the operation of stepper motors.

The motor is, for example a SAGEM 53 PP motor with 1 200 steps per revolution.

Figure 3:
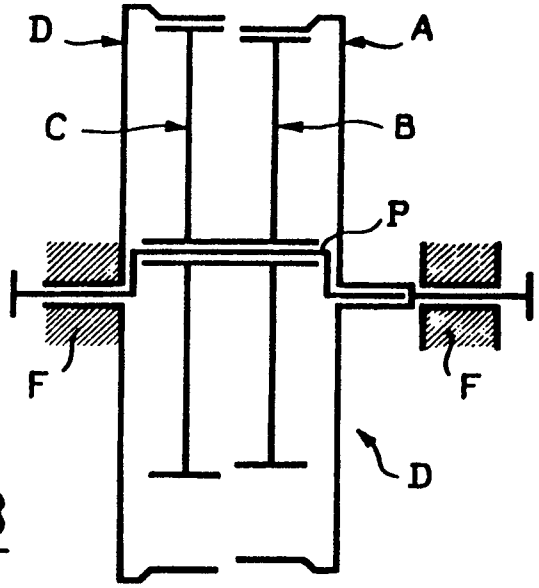
FIG. 3 is a diagram showing the operating principle of a differential epicyclic train incorporated in the support and drive device.

The train is a differential epicyclic train whose principle of operation will now be explained with reference to FIG. 3.

The differential D comprises a satellite-holder or eccentric P which is mounted to rotate about its axis X—X relative to a fixed support F.

The satellite-holder P carries two inner wheels B and C which are therefore rotated by the satellite-holder eccentrically to the axis X—X. The wheels B and C are coupled together. They rotate about their axis on the satellite-holder P.

The first inner wheel B meshes with a first outer wheel A rotating about the axis X—X of the train.

The second inner wheel D meshes with a second outer wheel D on the axis X—X but immobilized in rotation relative to the support F.

If ZA, ZB, ZC and ZD denote the numbers of teeth on the toothed wheels A, B, C and D and considering the mode of use shown in which the rotation speed ΩD of the outer wheel D is zero, then the ratio between the rotation speed ΩP of the satellite-holder and the rotation speed QA of the first outer wheel A is such that:

$$\frac{\Omega P}{\Omega A} = \frac{1}{1 - \frac{ZD \times ZB}{ZC \times ZA}}$$

To avoid geometrical interference between the teeth of the toothed wheels the following choices are made:

$$ZD - ZC \geqq N_{min}, \text{ and}$$

$$ZA - ZB \geqq N_{min}.$$

For standard teeth (pressure angle 20° ) and for more than 100 teeth, $N_{min} = 8$.

The eccentricity e of the satellite-holder is given by the equations:

$$e = \frac{(ZD - ZC) \times \text{wheel } D \text{ modulus}}{2}, \text{ and}$$

$$e = \frac{(ZA - ZB) \times \text{wheel } A \text{ modulus}}{2}.$$

Referring again to FIG. 2, in which the component parts of the differential D are identified by the same reference symbols, note that the differential is wholly contained within the cylindrical space delimited radially by the inner wall 36 and axially by the height or axial thickness of the stacked tapered roller bearings 38 and 40.

The differential D is therefore disposed "inside" the annular bearings 38 and 40 in the sense of the invention.

This very compact arrangement is achieved by virtue of the assembly now to be explained.

The central body 91 of the satellite-holder P rotates on the cylindrical extension 82 of the second coupling plate 22 on two inclined track ball bearings 92 and 94. The races of the bearings 92 and 94 are immobilized axially by clamping plates 96 and 98 clamped by screws 100 and 102.

The two inner wheels B and C rotate on the central body 91 of the satellite-holder on a pair of inclined track ball bearings 104 and 106 which carry an annular bush 108 which receives the wheels B and C.

The bearings 104 and 106 are clamped by plates 110 and 112 and the wheels B and C are clamped axially by a plate 114. Clamping is provided by screws 116 and 118.

The first outer wheel A is fixed to the first coupling ring 18 which for this purpose comprises a second cylindrical wall 120 to which the wheel A is attached by screws 122.

The second outer wheel D is attached to an inner radial shoulder 124 of the wall 36 by screws 126.

The train is therefore entirely contained within the bearings 38 and 40 and a cylindrical orifice or hole 128 coaxial with the axis X-X is obtained at the center of the device 18.

According to another aspect of the invention which is not shown in the figures, means are provided for measuring the angle of rotation.

This measurement is needed for verifying and calibrating the reference position, for periodically verifying the linearity of the rotation movement and the absence of step skipping, and to obtain redundant information additional to that supplied by the step counter of the motor 58.

It is proposed to use proximity sensors coupled in pairs, that is to say two pairs associated with the motor and two pairs associated with the coupling rings.

It is equally feasible to use low-resolution (0.1°) optical or electromagnetic absolute sensors.

It is also desirable to provide the drive table with thermal sensors for measuring the various temperatures and thermal gradients during start-up phases.

The main dimensional characteristics of the device in accordance with the invention are, for example, an overall diameter of 300 mm and an axial height of 45 mm excluding the motor.

The table is very stiff and can drive payloads with an inertia in excess of 200 kg.m$^2$ without requiring any further fixing point.

The angular resolution is better than 0.001° and the torque transmitted is in excess of 100 N.m.

THERE IS CLAIMED:

1. Device for supporting and rotating a payload relative to a structure comprising:

a first coupling ring joined to said payload;

a second coupling ring joined to said structure;

a pair of annular bearings for guiding rotation of said first coupling ring relative to said second coupling ring;

a differential epicyclic train disposed inside said annular bearings; and an annular motor having a stator fixed to one of said coupling rings and a rotor rotating the other coupling ring through said train.

2. Device according to claim 1 wherein said rotor of said motor is joined to a satellite-holder of said train which supports and rotates two inner wheels of said train each of which meshes with a respective one of two outer wheels of said train each of which is constrained to rotate with a respective one of said first and second coupling rings.

3. Device according to claim 2 wherein said inner and outer wheels and said satellite-holder of said train are disposed within an inner central space defined radially and axially by inner races of said two annular bearings.

4. Device according to claim 3 wherein said annular motor is outside said inner central space and is axially offset relative to said train.

5. Device according to claim 2 wherein said satellite-holder is of substantially annular shape so as to provide at the center of said device a central passage around the rotation axis of said device.

6. Device according to claim 1 wherein said pair of annular bearings comprises two taper roller bearings mounted back-to-back.

7. Device according to claim 1 incorporated in a spacecraft includes a launch vehicle, a satellite, an orbital space station and a space shuttle.

8. Device according to claim 1 employed to orient a mechanism comprising a set of sensors in a telescope.

9. Device according to claim 1 used to rotate a robotic arm.

* * * * *